United States Patent [19]

Maurer

[11] Patent Number: 4,626,236

[45] Date of Patent: Dec. 2, 1986

[54] APPARATUS FOR SEPARATING BAG ENDS DURING MANUFACTURE

[75] Inventor: Horst Maurer, Cumberland, R.I.

[73] Assignee: Windmoeller & Hoelscher Corporation, Lincoln, R.I.

[21] Appl. No.: 788,706

[22] PCT Filed: Jan. 20, 1982

[86] PCT No.: PCT/US82/00069

§ 371 Date: Sep. 20, 1983

§ 102(e) Date: Sep. 20, 1983

Related U.S. Application Data

[63] Continuation of Ser. No. 530,915, Sep. 20, 1983, abandoned.

[51] Int. Cl.[4] ..... B31B 1/80

[52] U.S. Cl. ..... 493/257; 493/259; 493/313; 493/315; 493/265; 493/332; 53/386

[58] Field of Search ..... 493/256, 257, 258, 259, 493/315, 409, 264, 265, 331, 332, 313; 29/730; 53/386, 385

[56] References Cited

U.S. PATENT DOCUMENTS

| | | | |
|---|---|---|---|
| 587,135 | 7/1897 | Murchie | 493/256 |
| 1,527,467 | 2/1925 | Bushbaum . | |
| 1,723,164 | 8/1929 | Hartman . | |
| 2,202,431 | 5/1940 | Rohrbacher | 493/409 |
| 2,671,385 | 3/1954 | Johenning et al. | 493/315 |
| 3,807,122 | 4/1974 | Kihnke et al. | 53/385 |
| 4,035,988 | 7/1977 | Daniels . | |
| 4,196,511 | 4/1980 | Kolosov et al. | 29/730 |
| 4,241,562 | 12/1980 | Meyer | 53/385 |
| 4,253,292 | 3/1981 | Lipes | 53/385 |

FOREIGN PATENT DOCUMENTS

| | | | |
|---|---|---|---|
| 28894 | 10/1884 | Fed. Rep. of Germany . | |
| 966438 | 10/1951 | Fed. Rep. of Germany . | |
| 1041342 | 10/1958 | Fed. Rep. of Germany | 493/257 |
| 1337996 | 8/1963 | France . | |
| 1577876 | 8/1969 | France . | |
| 2084662 | 12/1971 | France . | |

*Primary Examiner*—Francis S. Husar
*Assistant Examiner*—David B. Jones
*Attorney, Agent, or Firm*—Fleit, Jacobson, Cohn & Price

[57] ABSTRACT

A pair of specially designed suction wheels are preferably placed after the glue applicator on a known pinch bottomer bag-making machine. During manufacture, paper bags are guided horizontally through the machine by a conveyor forming part of the machine. With this arrangement, one of the suction wheels is placed under the bag, and the other wheel is placed over the bag in line. As each bag is moved by the conveyor, both suction wheels are brought into motion like a rolling operation. Each wheel has a shaft with a hollow channel going to a suction cup at the periphery of the wheel. The number of suction cups around the circumference of the wheel could be any amount. In a preferred embodiment, there are 12 equally spaced suction cups. A vacuum pump with a hose is connected onto the shaft. The pump draws air through the channel which comes from a suction cup so that, when the bag comes into the vicinity of the suction cup, the cup sticks on the bag layer. Because the bag is moving, the suction cup travels with the bag in the same direction. This action takes place simultaneously with both wheels. By doing so, the two layers of the bag cling to the suction cups. By making a radius, up and down, the bag opens.

4 Claims, 4 Drawing Figures

APPARATUS FOR SEPARATING BAG ENDS DURING MANUFACTURE

This application is a continuation of application Ser. No. 530,915, filed Sept. 20, 1983, abandoned.

TECHNICAL FIELD

The present invention relates to improvements to a pinch bottomer, which is a machine that makes paper bags. A novel apparatus is disclosed for ensuring that the two layers constituting the open end of the paper bag remain separated after a hot melt sealing bead has been dispensed on the open end.

BACKGROUND ART

Paper bags are typically made with one closed end and one open end. The open end has hot melt as a thermoplastic bead or film applied so that, when the customer gets the bag, he puts in his material and then passes the open end of the bag through a heat sealer to close and seal the bag with the glue for this operation being provided by the hot melt. When the bag is passed horizontally through a conventional pinch bottomer by a pair of conveyor belts, the hot melt glue is put on by extrusion or by wheel. The end of the bag, if it is a multiple ply bag, consists of a number of layers which are staggered so the glue will be applied to the end of each layer. The problem is that, when the bags come out of the hot melt application station, they cannot be easily opened because the various layers in each bag stick together. So far, it has been proposed to blow air in between the layers. However, this introduces contaminants into the bag. As another alternative, the bags may be opened by hand, which can be quite clostly.

DISCLOSURE OF THE INVENTION

According to the present invention, a pair of specially designed suction wheels are preferably placed after the glue applicator on the pinch bottomer bag-making machine. During manufacture, the paper bags are guided horizontally through the machine by a conveyor forming part of the machine. With this arrangement, one of the suction wheels is placed under the bag, and the other wheel is placed over the bag in line. As each bag is moved by the conveyor, both suction wheels are brought into motion like a rolling operation.

Each wheel has a shaft with a hollow channel going to a suction cup at the periphery of the wheel. The number of suction cups around the circumference of the wheel could be any amount. In a preferred embodiment, there are 12 equally spaced suction cups. A vacuum pump with a hose is connected onto the shaft. The pump draws air through the channel which comes from a suction cup so that, when the bag comes into the vicinity of the suction cup, the cup sticks on the bag layer. Because the bag is moving, the suction cup travels with the bag in the same direction. This action takes place simultaneously with both wheels. By doing so, the two layers of the bag cling to the suction cups. By making a radius, up and down, the bag opens.

BEST MODE FOR CARRYING OUT THE INVENTION

Figure 1:
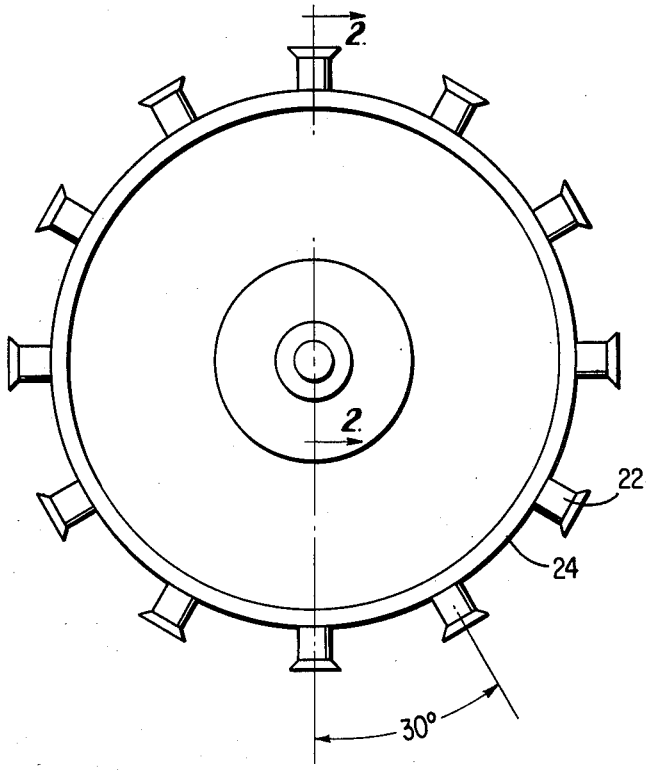
FIG. 1 is a side plan view of one of the two identical wheels forming part of the bag opening apparatus of the present invention.

According to the present invention, as shown in FIGS. 1 through 4, a pair of specially designed suction wheels 12 and 14 are preferably placed after the glue applicator on a known pinch bottomer bag-making machine. One machine found useful for practicing the present invention is made by Icoma Packtechnik GmbH, Acher, West Germany, and bears Model No. PB2350. During manufacture, paper bags 16 are guided horizontally through the machine by a conveyor forming part of the machine. With this arrangement, one of the suction wheels 14 is placed under the bag 16, and the other wheel 12 is placed over the bag in line with wheel 14. As each bag is moved by the conveyor, both suction wheels are brought into motion like a rolling operation.

Figure 4:
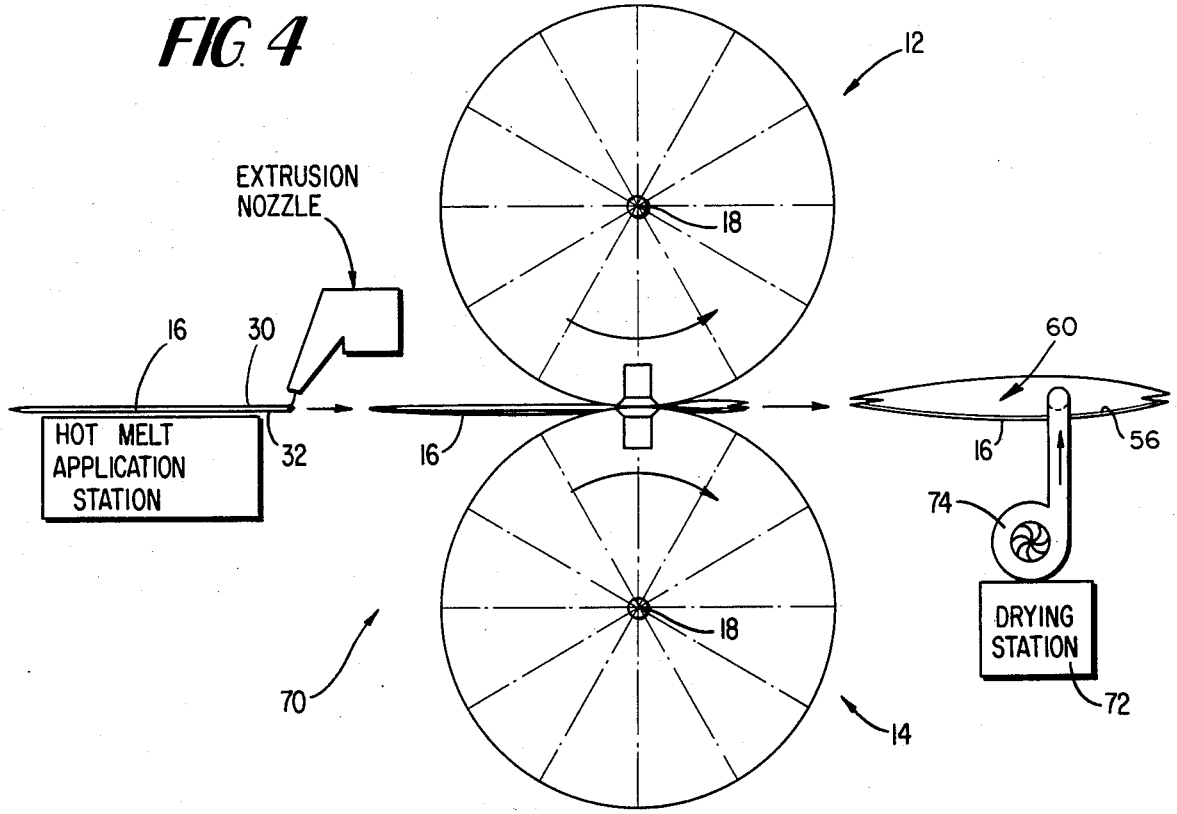
FIG. 4 is a schematic diagram showing a bag entering a separating station made up of a pair of suction wheels of the type shown in FIG. 1.
Figure 2:
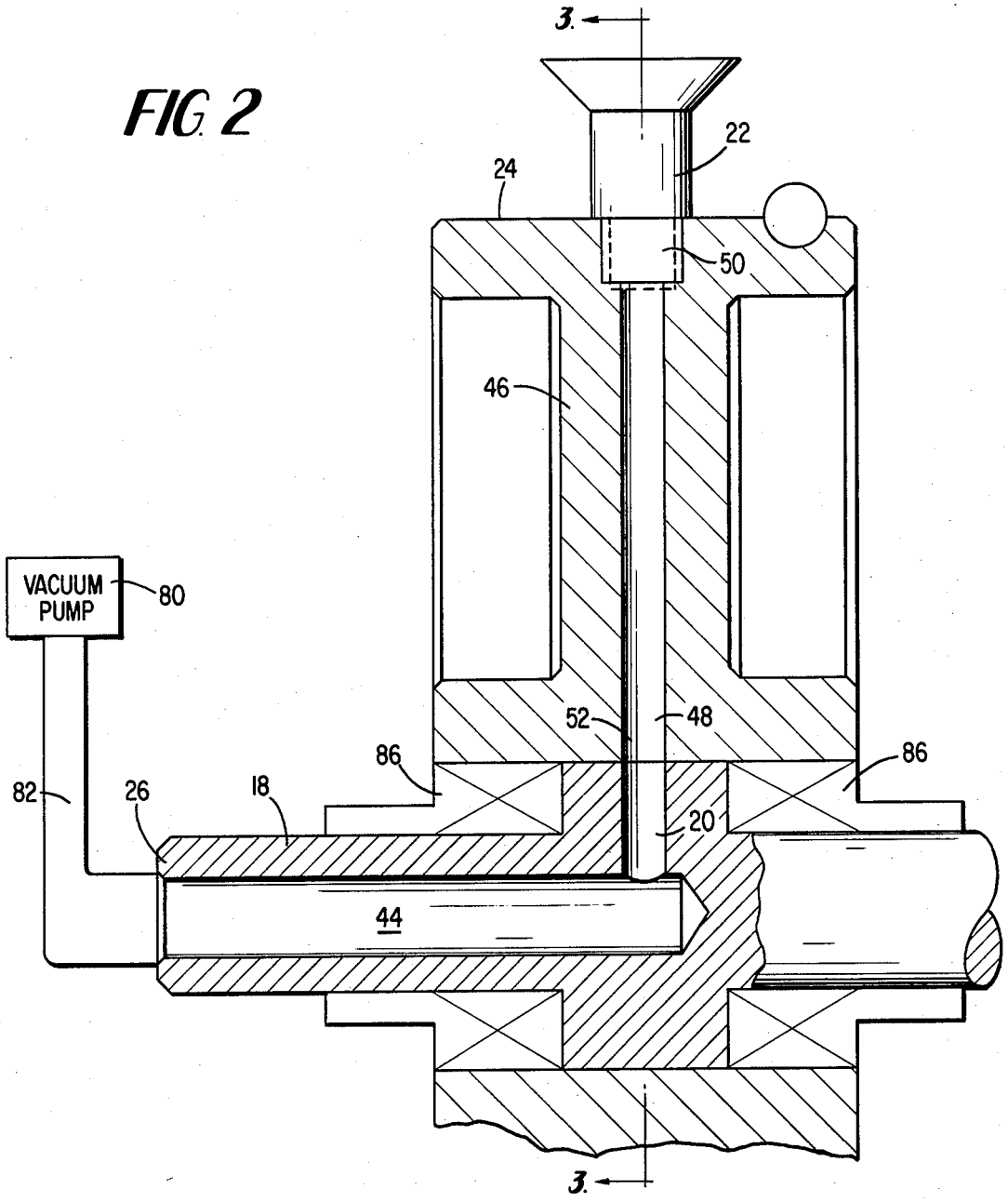
FIG. 2 is a view taken along lines 2—2 of FIG. 1.
Figure 3:
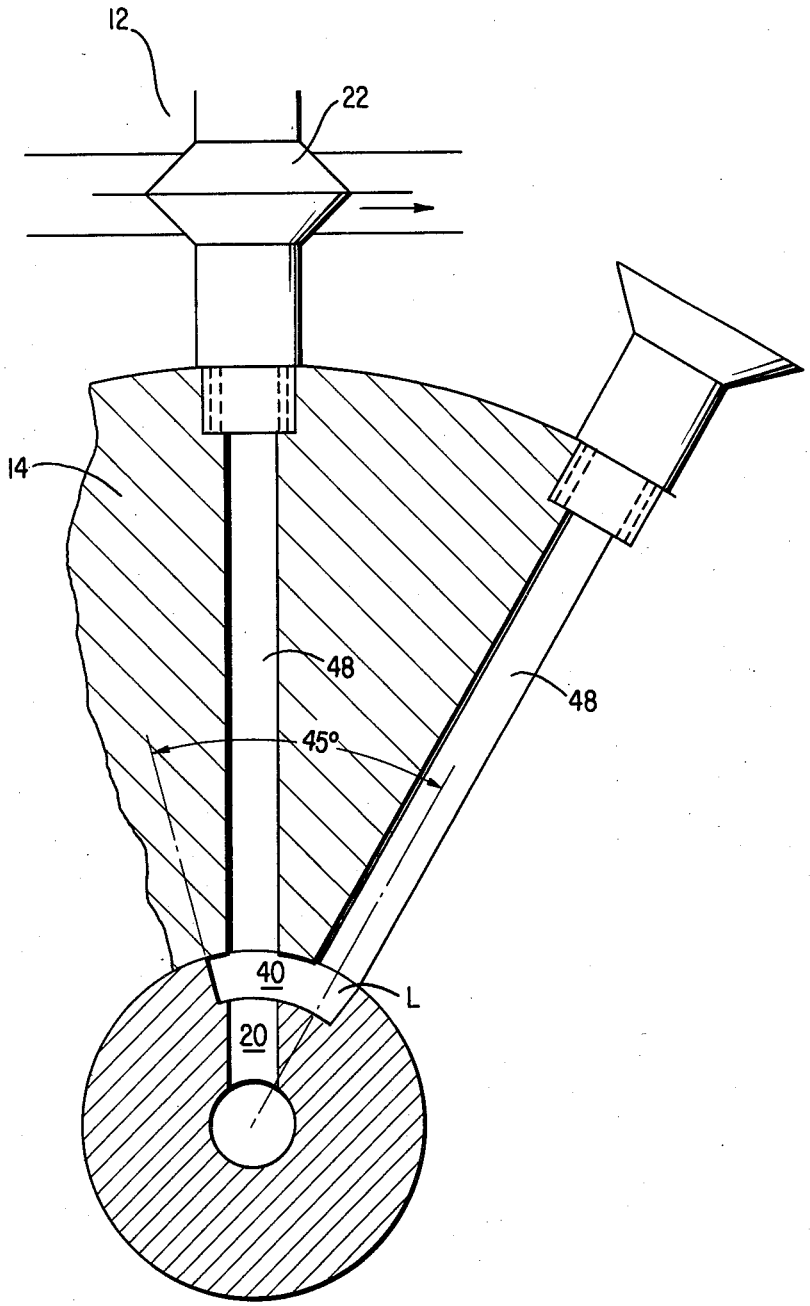
FIG. 3 is a view taken along lines 3—3 of FIG. 2.

Each wheel has a shaft 18 with a hollow channel 20 (FIGS. 2 and 3) of essentially uniform cross-section going to a suction cup 22 at the periphery of the wheel. The number of suction cups around the circumference of the wheel could be any amount. In a preferred embodiment, there are 12 equally spaced suction cups. A vacuum pump 80 with a hose 82 is connected to one end 26 of the shaft. The pump draws air through the channel which comes from a suction cup so that, when the bag comes into the vicinity of the suction cup, the cup sticks on the bag layer. Because the bag is moving, as shown in FIG. 4, the suction cup 22 travels with the bag in the same direction. This action takes place simultaneously with both wheels. By doing so, the two layers of the bag cling to the suction cups. By making a radius, up and down, the bag opens.

Preferably not all of the suction cups 22 should be subjected to suction. To do otherwise results in tremendous loss of vacuum. Further, maintaining the suction for too great a period in the production cycle could rip the bag apart. For this reason, the vacuum must be stopped at a certain point which corresponds to the maximum dimension necessary to pull the bag apart. This is achieved by cutting out a segment 40 of the shaft 18. The segment spans a predetermined angle. In a preferred embodiment, this angle is about 45°. The segment 40 is in fluid communication with the radial channel 20 which, in turn, is in fluid communication with the longitudinal bore 44. Rotatably mounted on the shaft 18 a wheel member 46 is provided, in a preferred embodiment, with 12 radial bores 48. Each wheel member is mounted by essentially air tight bearings 86. Each bore 48 has one end 50 in fluid communication with a suction cup 22 and another end 52 positioned so that it will be in fluid communication with segment 40 as the wheel member rotates.

In operation, the shaft 18 remains stationary, and the wheel 46 rotates about the shaft. In this way, each suction cup will be in fluid communication with segment 40 some time during one rotation of the wheel member 46. When a suction cup moves out of segment 40, suction ceases, and the suction cup lets go of the layer of the bag at the appropriate time. In the case of wheel 12, layer 30 is released and, for wheel 14, layer 32 is released. The shaft 18 for each wheel 12,14 is mounted on the pinch bottomer so that you can move the whole shaft up or downstream in the bag-making operation. The shaft may also be turned on its axis to change the location of segment 40 relative to the position of the bag layers. After suction is applied, the bag opening 60 is separated. The next bags come, one after the other, and both of the wheels 12 and 14 keep rotating. The layers of the open end of the next bag will be picked up by a different suction device 22 with the bag-opening operation being repeated. One bag usually rolls over ten suction cups 22 to be opened completely, and the next bag is in position.

Preferably, the wheels 12 and 14 are located after the gluing section of the known pinch bottomer. However, other locations will suggest themselves to those skilled in the art. The only requirement is that the wheels be arranged in line, of course, with the end of the bag wherever that travels. The two wheels 12 and 14 must be in line with the end layers 30 and 32 of the bag 16 so that a suction cup 22 on each wheel grabs the two bag surfaces 30 and 32 somewhere before the end of the bag travel, so that at the end of the bag travel the rotation of each wheel 12,14 will have separated the two surfaces 30 and 32.

After the separation operation in the separation station 70 is complete, the bag 16 with separated layers 30 and 32 is transported by conveyor to a stacker station where the bags are placed in stacks. Forming part of the stacker station may be a drying station where the hot melt glue 56 is dried so the bags do not stick together. For example, the drying station 72 may have air blowers 74 to keep the bags 16 open for awhile to ensure drying. In a preferred embodiment, the wheel members 46 for each wheel 12 and 14 are aluminum, and the shafts are steel. For wheel rotation, there are two versions; in one version, the wheel member is driven by conventional means, such as pulleys, to be totally synchronized with the conveyor belt speed of the pinchbottomer, so the surface of the suction cups 22 will be the same speed as the conveyor belts that transport the bags 16. In the other version, the wheel member is driven by the suction cups holding onto the bags.

Obviously many modifications and variations of the present invention are possible in light of the above teachings. For example, the shaft of each wheel may be adjusted in known manner, such as by a movable clamp, and moved up and downstream along the conveyor belt to accommodate bags of different sizes. In this way, each bag, according to its size, may be grabbed by the suction cups in the appropriate way. It is, therefore, to be understood that, within the scope of the appended claims, the invention may be practiced otherwise than as specifically described.

I claim:

1. A bag making machine, comprising:

means for applying a hot melt sealing material to at least one of the edges of the top and bottom layers of a flat, tubular bag preform having at least one open end;

conveyor means for guiding the tubular bag preform horizontally through the machine;

a first stationary support shaft on one side of said conveyor means after said sealing material applying means, said first support shaft carrying a first bearing means and having first internal conduit means in communication with an external source of vacuum;

a first wheel rotatably supported on said first bearing means of said first support shaft;

a second stationary support shaft on an opposite side of said conveyor means after said sealing material applying means, said second support shaft carrying a second bearing means and having second internal conduit means in communication with the external source of vacuum;

a second wheel rotatably supported on said second bearing means of said second support shaft;

each of said first and second wheels including a control hub, a peripheral portion carrying a plurality of circumferentially disposed, bag-contacting suction cups, and conduit means providing communication between said control hub and each of said suction cups, said hub communicating with said conduit means of said shaft to provide bag gripping vacuum at said suction cups during only a part of a revolution of said wheel;

said first and second support shafts being positioned on the opposite sides of said conveyor belt with the respective axes thereof essentially parallel to and spaced from each other so that respective pairs of suction cups of said first and second wheels are positioned opposite to each other as said first and second wheels rotate to define a plurality of circumferentially spaced bag contacts therebetween;

said first and second wheels being arranged in line to receive the end of a bag preform between said pairs of oppositely positioned suction cups, said suction cups moving with and in the same direction as the bag preform for overcoming a tendency for the hot melt sealing material to cause the edges of said top and bottom layers to stick together, and thereby separating the edges to open the end of the bag preform; and air blower means for keeping the end of the bag preform open after the bag preform emerges in the open condition from between said rotating first and second wheels, to permit drying of the hot melt sealing material and thereby preclude the edges of the bag preform from subsequently becoming unintentionally stuck together by the hot melt sealing material.

2. The bag making machine of claim 1, wherein said internal conduit means in each of said support shafts includes a first section extending through said support shaft essentially along a central axis thereof, and a second section of essentially uniform cross-section extending from an inner end of the first section and essentially radially of said support shaft to a periphery of said support shaft, and wherein an arcuate channel of a preselected length is formed in the periphery of said support shaft in communication with an outer end of the second section and opposite the control hub of the respective wheel, such that said arcuate channels simultaneously place successive pairs of said conduit means in said wheels in communication with said internal conduit means in their respective support shafts for a preselected time period, to separate the layers of the bag preform passing between said wheels without tearing the bag preform.

3. The bag making machine of claim 1 wherein for each of said first and second support shafts, the circumferential extent of said arcuate channel is defined by an arc of approximately 45°.

4. The bag making machine of claim 3 wherein said conduit means in each of said first and second wheels comprises a plurality of radial channels, each of which extends from said central hub to one of said suction cups.

* * * * *